US006470655B1

(12) United States Patent
Schwede

(10) Patent No.: US 6,470,655 B1
(45) Date of Patent: Oct. 29, 2002

(54) PACKAGING LINE FOR PERIODICALS, MAGAZINES AND SIMILAR PRINTED PRODUCTS

(75) Inventor: Roland Schwede, Goldkronach (DE)

(73) Assignee: SMB Schwede Maschinenbau GmbH, Goldkronach (DE)

( * ) Notice: Subject to any disclaimer, the term of this patent is extended or adjusted under 35 U.S.C. 154(b) by 0 days.

(21) Appl. No.: 09/562,955

(22) Filed: May 3, 2000

(30) Foreign Application Priority Data

May 5, 1999 (DE) ..... 199 20 531

(51) Int. Cl.[7] ..... B65B 11/00

(52) U.S. Cl. ..... 53/586; 53/589; 53/582; 53/176; 53/157; 53/375.6; 53/201; 100/3; 100/7; 100/26; 100/27; 414/788; 414/788.1; 414/788.9

(58) Field of Search ..... 53/589, 582, 445, 53/176, 157, 209, 228, 229, 375.6, 201; 100/26, 25, 27, 7, 3; 414/907, 788, 786, 788.1, 788.9, 789.5

(56) References Cited

U.S. PATENT DOCUMENTS

| | | | | |
|---|---|---|---|---|
| 3,343,334 A | * | 9/1967 | Bode et al. | 53/124 |
| 4,870,807 A | * | 10/1989 | Palamides et al. | 53/528 |
| 5,078,057 A | | 1/1992 | Pearson | |
| 6,085,487 A | * | 7/2000 | De Vlaam | 53/176 |

FOREIGN PATENT DOCUMENTS

| | | | |
|---|---|---|---|
| DE | 2411387 | | 9/1974 |
| DE | 3140291 | A1 | 4/1983 |
| DE | 3937044 | A1 | 5/1991 |
| DE | 19615009 | A1 | 10/1997 |
| DE | 19630964 | A1 | 2/1998 |
| EP | 0113874 | | 12/1983 |
| EP | 0725005 | B1 | 1/1996 |

* cited by examiner

*Primary Examiner*—Eugene Kim
*Assistant Examiner*—Thanh Truong
(74) *Attorney, Agent, or Firm*—Browdy and Neimark

(57) ABSTRACT

A packaging line for periodicals, magazines and similar printed products comprises at least four of the following functional components

- a first strapping device for the longitudinal or cross-strapping of the stack of products arriving from a compensating stacker or the like,
- a top sheet feeder,
- a film wrapping device for wrapping the stack of products with a packaging film and for welding the packaging film on two opposing sides of the stack of products,
- a second strapping device for the longitudinal strapping of the stack of products,
- a welding device for welding the sides of the packaging film which have remained unwelded in the film wrapping device, and
- a third strapping device for cross-strapping the stack of products.

In each case, two or more of the functions are integrated in pairs or multiply in a combined component of the packaging line in such a way that conveyor sections and/or stops in sequence in a combined component are used for at least two handling and processing stages in the packaging line in each case.

7 Claims, 1 Drawing Sheet

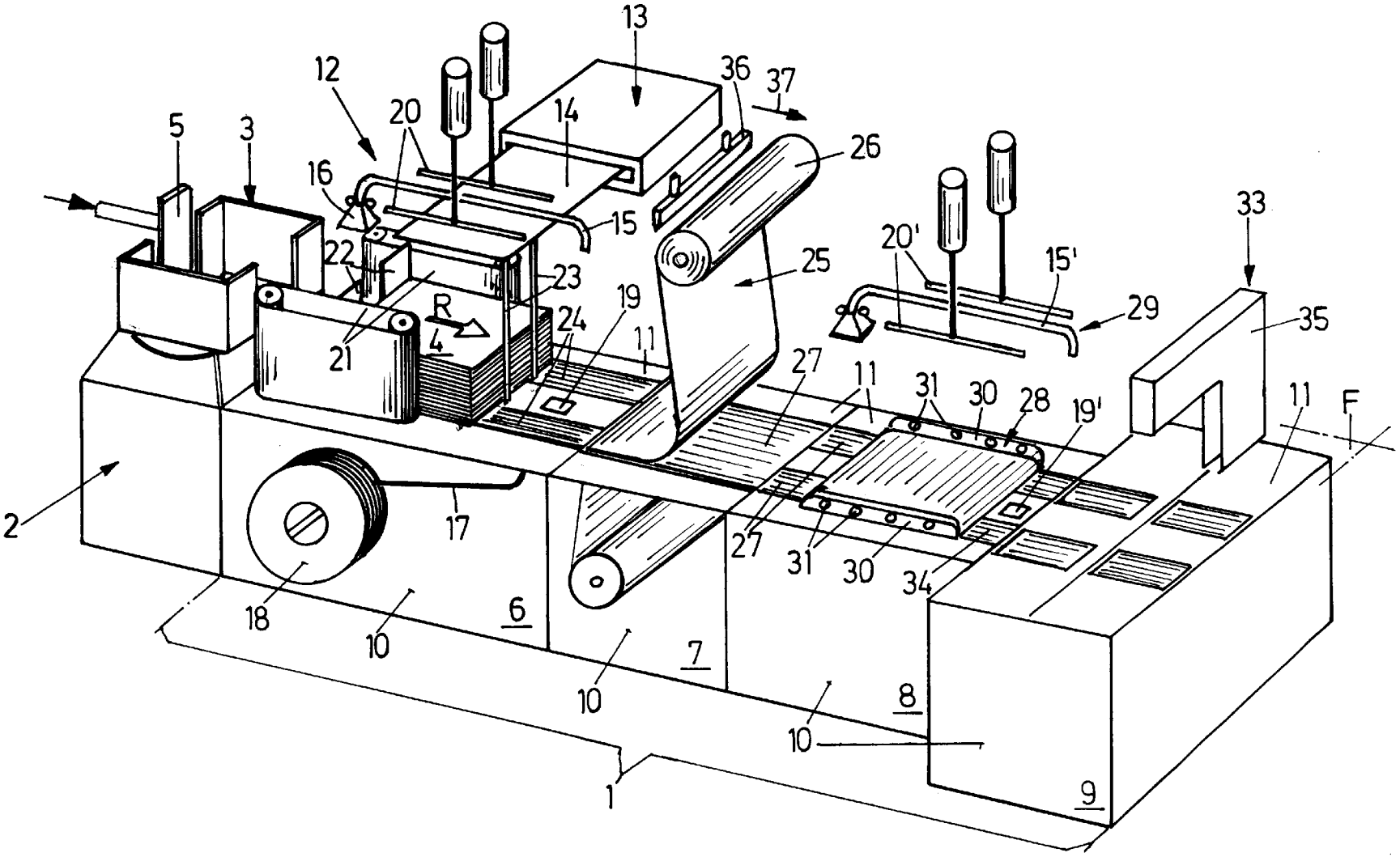
1
2
3
4
5
6
7
8
9
10
11
12
13
14
15
15'
16
17
18
19
19'
20
20'
21
22
23
24
25
26
27
28
29
30
31
33
34
35
36
37
F
R

PACKAGING LINE FOR PERIODICALS, MAGAZINES AND SIMILAR PRINTED PRODUCTS

BACKGROUND OF THE INVENTION

1. Field of the Invention

The invention relates to a packaging line for periodicals, magazines and similar printed products.

2. Background Art

It is pointed out as background to the invention that the demands placed on the design and, in particular, the space requirement of packaging lines of the type mentioned at the outset have changed considerably. This is due to the fact that more space is required in printing lines for so-called insetting machines for inserting advertising material ranging from simple brochures through product samples to data carriers. The increased space requirement for insetting machines in a given amount of space has to be compensated for by savings in other components of the printing lines, and packaging lines of the so-called compensating stacker type for stitched printed products are also available for this purpose.

The conventional processing of compensated stacks of periodicals accordingly involves, after the compensating stacker, a top sheet feed, a film wrapping, a lateral welding of the film wrapping which is only carried out with very small packages, a transverse strapping device, a turning station and a second transverse strapping device. Cross-strapping of the stack of periodicals is achieved by means of the three last-mentioned components.

Longitudinal strapping machines have already been known for a long time, and, when combined with a cross-strapping machine, allow the turning station for the stack of periodicals to be dispensed with. Therefore, the length of the strapping station as such has already been reduced.

A further problem in the handling of packages of periodicals is their lability. This problem is intensified by the use of high-quality, very smooth papers as the stacked printed products can very easily slide off one another and the stack can be destroyed. To overcome this problem, attempts have been made to reduce the conveyance path after the compensating stacker using appropriate handling components and thus to support and hold labile packages of periodicals with baskets or grippers. Such equipment has a very complex construction as an overall system and usually has the drawback that, although space is saved in the length of the installation, more space is required in width. Therefore, the saving of net area is slight and still in great need of improvement. Moreover, closed complete handling of this type has the further drawback that all components are usually assembled in a single protective cell which is monitored by corresponding sensors. During an interruption in the plant, the plant cannot be entered by the operator without stopping the entire plant. In extreme cases, this means that the complete packaging line has to be stopped if a single address label falls, for example, in the top sheet feed.

SUMMARY OF THE INVENTION

Starting from the aforementioned problems, it is the object of the invention to design a packaging line for periodicals, magazines and similar printed products in such a way that a considerable saving of space is achieved with a predetermined combination of functions.

This object is achieved according to the invention essentially in that, in each case, two or more of the functions of the packaging line are integrated in pairs or multiply—i.e. in a multiple combination—into a combined component of the packaging line. Integration is achieved by using conveying sections and/or stops in sequence in a combined component for, in each case, at least two handling and processing stages of the packaging line.

Preferably, a top sheet feeder can be combined with a first strapping device, for example in a first combined component. The package is therefore occupied by the top sheet at the very beginning of the packaging line during a stop in the sequence and is secured by the first strapping and can be handled far more simply and without disturbances thereafter. Therefore, this first strapping represents so-called "industrial" strapping which has nothing to do with the final bundling as such.

A second combined component designed as a film wrapping device can follow. This film wrapping device does not have its own inlet conveyor belt but is fed directly by the outlet conveyor belt of the first component. It therefore utilizes the conveyor section of the previous component for itself. Therefore, the overall length of the packaging line can again be reduced by dispensing with the inlet belt for wrapping of the film. Furthermore, synchronization of the film wrapping with the outlet conveyor belt of the previous component allows welding of the film wrapper by a travelling welding terminal, so it is not necessary to stop the sequence in this component.

In a further combined component, for example, a strapping device with lateral welding can be provided for the packaging films placed round the stack of products by the film wrapping device. Therefore, two functions are again integrated into a double-action, combined component, and this is accompanied by a considerable gain in space.

Finally, the packaging line can be completed by a further strapping device, the two last-mentioned strapping devices carrying out final cross-strapping of the stack of products.

Further features, advantages and details of the invention can be inferred from the following description, in which an embodiment of the subject of the invention is described in more detail with reference to the accompanying drawing.

BRIEF DESCRIPTION OF THE DRAWING

FIG. 1 shows a highly schematic perspective view of a packaging line.

DESCRIPTION OF THE PREFERRED EMBODIMENT

The packaging line designated as a whole by 1 adjoins the compensating stacker 2 of a printing line. A specific number of printed products with a first orientation of the binding edge is inserted into the compensating stacker 2 in a known manner, whereupon the compensating stacker 2 is rotated through 180 ° about a vertical axis and the specific number of printed products is again inserted in the same orientation of the binding edge. A stack of products is therefore formed in which partial stacks have an opposing orientation of the binding edge. A straight stack of cleanly layered printed products is thus created. As soon as a specific number of printed products is collected in the basket 3 of the compensating stacker 2, the basket is opened and the stack 4 is fed to the packaging line 1 by a delivery slider 5. The packaging line 1 comprises four combined components 6, 7, 8, 9 which will be described in more detail hereinafter. The components 6, 7, 8, 9 have the common feature that they comprise table- or cupboard-like bases 10 which form a work surface 11 with their upper faces. The upper faces are in turn arranged in a common conveying plane F for the stack of periodicals 4.

The combined component 6 which directly adjoins the compensating stacker 2 combines a first strapping device 12 and a top sheet feeder 13 which places a top sheet 14 from the side onto the stack 4 which has been driven into the first component 6. The top sheet feeder 13 is of conventional design and, therefore, needs no further explanation.

The first strapping device 12 is of a type which has no tape duct portions projecting upwardly from the work surface 11. Therefore, FIG. 1 also only shows one guide duct portion 15 with a collecting device 16 for the strapping tape 17. The mode of operation and construction of this type of strapping device is described comprehensively and in detail in German Offenlegungsschrift DE 195 03 112 A1 and European patent EP 0 725 005 B1. Therefore, it will only be pointed out briefly here that the strapping tape 17 is conveyed from a tape supply reel 18 into a temporary store, not shown. During a strapping process, the tape is shot from there via a first free air gap between the work surface 11 and the collecting device 16, is taken up by the collecting device 16 and conveyed on in the guide duct portion 15, issues again at the opposite end of the guide duct portion 15 and is shot down into a second collecting device 19 via the second free air gap. In a welding head below the work surface 11, after tightening of the strapping tape placed slackly round the stack 4, the loop of tape is closed and severed from the entering supply of tape.

After application of the top sheet 14, the two clamping bars 20 are also pressed onto the stack 4 from above in order to keep it compact during the subsequent strapping process.

The two lateral guide and conveying walls 21 which are designed in the manner of an endless conveyor belt and are provided with feed plates 22 are also used on the one side for handling the stack 4 in the first combined component 6. These feed plates 22 enter behind the stack 4 maneuvered onto the work surface 11 by the delivery slider 5 of the compensating stacker 2 and push it against the package stop 23 which can be driven in laterally. The not yet strapped stack is guided cleanly by the lateral guide walls 21, the feed plates 22 and the package stop 23 and cannot fall over during this feed motion.

After the first strapping serving merely as auxiliary strapping in the case illustrated, the stack 4 is held together and can therefore be conveyed on using conventional conveyor belts. Therefore, the stack 4 passes from the first combined component 6 through its delivery conveyor belt 24 which is synchronized with the second combined component 7 — a film wrapping device — in such a way that the movement of the delivery conveyor belt 24 simultaneously serves to insert the stack 4 into the film wrapping device 7.

The film wrapping device 7 has a conventional and known mode of operation and does not require further explanation. It should merely be stated that the stack 4 travels toward a "curtain" of the packaging film 25 which can therefore be brought beneath, in front of, on and, by a corresponding process involving the upper supply roll 26 for the packaging film 25, also behind the stack 4. The stack 4 is then welded at the back by the welding terminal 36 in the combined component 7. The sides remain open. The welding terminal 36 can travel synchronously with the stack 4 in the direction of the arrow 37 so that it is not necessary to stop in order to weld the stack 4. The tube of film formed round the stack 4 by the packing film 25 can optionally also be welded at the sides, the front and back of the stack 4 then remaining open.

The wrapped stack 4 passes via the conveyor belt 27 of the film wrapping device 7 into the third combined component 8 which combines a lateral welding device 28 with a second strapping device 29. The second strapping device 29 has the same construction and mode of operation as the first strapping device 12 and so does not require further explanation. Corresponding components are provided with corresponding reference numerals with apostrophes.

The lateral welding device 28 comprises welding terminals 30 with schematically indicated spot welding units 31. Owing to the arrangement of the functional component 8 to the side of the conveyor belts 34, therefore, spot welding takes place there at the sides of the packaging film. This spot welding is carried out only with very small stacks. Higher stacks receive longitudinal strapping by the strapping device 29 after film wrapping in the functional component 7.

A cross-strapping device 33 follows in the last component 9 and is in turn fed on the inlet side by the conveyor belts 34 of the previous functional component 8. The cross-strapping device 33 can have a free air gap — in other words, no tape duct portion projecting upwardly from the work surface 11 — on one side of the tape guide frame 35, in accordance with the other two strapping devices 12, 29. The ready-packaged, cross-strapped stack 4 can therefore be pushed out laterally not only in the conveying direction R of the packaging line 1 but also at right angles to it, if necessitated by the spatial conditions of the site of erection of the packaging line 1 and the further handling of the stack 4.

It is also pointed out that the directions of welding — in other words, lateral welding on the one hand and front and back welding on the other hand can also be carried out in the reverse sequence to the previous description. The sequence of the strapping directions in the two strapping devices 29, 33 can also be exchanged and the second welding of the packaging film 25 can also be carried out in the last functional component 9.

As demonstrated by the foregoing remarks, the concept of assembling various combined components also allows a maximum of flexibility for producing a packaging line. It is therefore possible to use only partial elements of various combined components, to interchange various elements or also to separate them spatially by bridging sections if other criteria are involved, rather than the actual aim of obtaining equipment which is as compact as possible. All components can also be used as an individual machine without the preceding and following component.

What is claimed is:

1. A packing line for periodicals, magazines and other printed products with at leas four of the following devices:

a first strapping device (12) for one of a longitudinal and cross-strapping of a stack of products (4) being fed into the packaging line, a top sheet feeder (13), a film wrapping device (7) for wrapping the stack of products (4) with a packaging film (25) and for welding the packaging film (25) on two opposing sides of the stack of products (4), a second strapping device (29) for the longitudinal strapping of the stack of products (4), a welding device (31) for welding the sides of the packaging film (25) which have remained unwelded in the film wrapping device (7), and a third strapping device (33) for cross-strapping the stack of products (4), wherein the packaging line comprises conveyor sections and sequential stops and wherein at least two of said devices are integrated in pairs or multiply in a combined component (6, 7, 8, 9) of the packaging line in such a way that at least one of said conveyor sections and of said sequential stops in a combined component (6, 7, 8, 9) is used for at least two handling and processing stages in the packaging line (1), respectively.

2. A packaging line according to claim 1, wherein ad least one of said first, second and third strapping devices (12, 29, 33) comprises belt guides which have no tape duct portions which project upwardly from a work surface of said strapping devices (12, 29, 33).

3. A packaging line according to claim 1, wherein an outlet conveyor belt (27) of a component (6) is used as an inlet conveyor belt of a subsequent component (7).

4. A packaging line according to claim 1, wherein a first combined component (6) comprises a top sheet feeder combined with a first strapping device (12).

5. A packaging line according to claim 1, wherein a second combined component (7) is a film wrapping device of which an inlet conveyor belt is formed by an outlet conveyor belt (27) of the first combined component (6).

6. A packaging line according to claim 1, wherein a third functional component (8) comprises a strapping device (29) combined with a lateral welding device (31) for a packaging film (25) round the stack of products.

7. A packaging line according to claim 1, comprising a further strapping device (33) at an end of the packaging line (1).

* * * * *